US011420232B2

(12) United States Patent
Otto et al.

(10) Patent No.: US 11,420,232 B2
(45) Date of Patent: Aug. 23, 2022

(54) VIBRATION GENERATOR AND METHOD FOR GENERATING VIBRATIONS

(71) Applicant: BAUER Maschinen GmbH, Schrobenhausen (DE)

(72) Inventors: Hans-Philipp Otto, Aichach (DE); Wolfgang Kraus, Schrobenhausen (DE)

(73) Assignee: BAUER Maschinen GmbH, Schrobenhausen (DE)

( * ) Notice: Subject to any disclaimer, the term of this patent is extended or adjusted under 35 U.S.C. 154(b) by 581 days.

(21) Appl. No.: 16/483,223

(22) PCT Filed: Jan. 24, 2018

(86) PCT No.: PCT/EP2018/051684
§ 371 (c)(1),
(2) Date: Aug. 2, 2019

(87) PCT Pub. No.: WO2018/141601
PCT Pub. Date: Aug. 9, 2018

(65) Prior Publication Data

US 2020/0230652 A1 Jul. 23, 2020

(30) Foreign Application Priority Data

Feb. 3, 2017 (EP) ..... 17154559

(51) Int. Cl.
*E01C 19/28* (2006.01)
*B06B 1/16* (2006.01)

(52) U.S. Cl.
CPC ..... *B06B 1/166* (2013.01); *E01C 19/286* (2013.01)

(58) Field of Classification Search
CPC ..... B06B 1/166; E01C 19/286
(Continued)

(56) References Cited

U.S. PATENT DOCUMENTS 3,670,631 A 6/1972 Gaylor
3,817,646 A * 6/1974 Opderbeck ..... E02D 3/074 404/133.1

(Continued)

FOREIGN PATENT DOCUMENTS

CN 1605680 A 4/2005
DE 1 920 221 U 7/1965

(Continued)

OTHER PUBLICATIONS

An Office Action mailed by the National Intellectual Property Administration of the People's Republic of China dated Aug. 4, 2020, which corresponds to Chinese Patent Application No. 201880010070.1 and is related to U.S. Appl. No. 16/483,223; English language translation.

(Continued)

*Primary Examiner* — Raymond W Addie
(74) *Attorney, Agent, or Firm* — Studebaker & Brackett PC

(57) ABSTRACT

A vibration generator has a first rotationally drivable imbalance shaft, on which a first imbalance is arranged, at least one second rotationally drivable imbalance shaft, on which a second imbalance is arranged, a joint drive for rotationally driving the two imbalance shafts and a transmission arrangement which is arranged between the drive and the imbalance shafts for transmitting a torque of the drive to the imbalance shafts. The transmission arrangement distributes an input torque of the drive to a first output element for the first imbalance and a second output element for the second imbalance. For the torque transmission a first deflection element is arranged between the transmission arrangement and the first imbalance shaft and for the torque transmission a second deflection shaft is arranged between the transmission arrangement and the second imbalance shaft.

12 Claims, 5 Drawing Sheets

Figure 1:
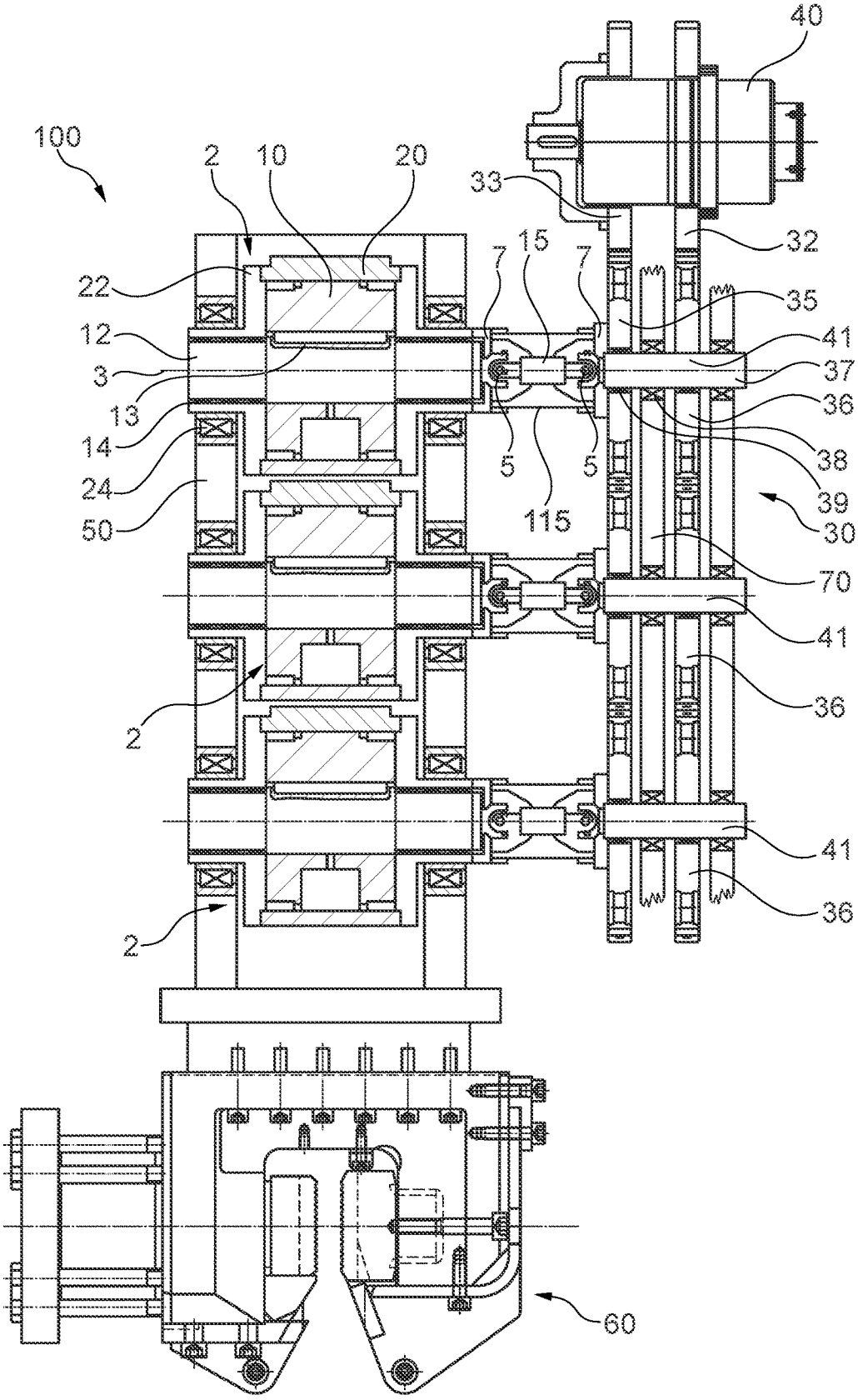

(58) Field of Classification Search
USPC ..... 404/70, 113, 117, 133.05, 133.1
See application file for complete search history.

(56) References Cited

U.S. PATENT DOCUMENTS

| | | | | |
|---|---|---|---|---|
| 4,830,597 | A | 5/1989 | Steier et al. | |
| 5,584,375 | A | 12/1996 | Burgess, Jr. et al. | |
| 5,934,824 | A | 8/1999 | Vural | |
| 6,227,760 | B1 * | 5/2001 | Togami | E01C 19/38 74/61 |
| 6,551,022 | B1 * | 4/2003 | Stayner | E01C 19/38 404/133.05 |
| 6,837,648 | B1 * | 1/2005 | Wadensten | E01C 19/283 404/117 |
| 7,302,871 | B2 * | 12/2007 | Laugwitz | B06B 1/16 404/133.05 |
| 7,316,524 | B1 * | 1/2008 | Pikuet | E01C 19/38 404/114 |
| 8,502,403 | B2 * | 8/2013 | Merswolke | F03D 7/0276 290/44 |
| 2004/0173040 | A1 | 9/2004 | Laugwitz | |
| 2011/0033234 | A1 * | 2/2011 | Mendler | F16D 3/60 404/102 |

FOREIGN PATENT DOCUMENTS

| | | | |
|---|---|---|---|
| DE | 42 24 113 | A1 | 2/1994 |
| DE | 295 1 6 602 | U1 | 12/1995 |
| DE | 102 35 980 | A1 | 5/2003 |
| DE | 10 2010 056 531 | A1 | 7/2011 |
| EP | 3 228 392 | A1 | 10/2017 |
| GB | 1 536 765 | A | 12/1978 |
| JP | 2002-129563 | A | 5/2002 |

OTHER PUBLICATIONS

International Search Report issued in PCT/EP2018/051684; dated May 30, 2018.
International Preliminary Report On Patentability issued in PCT/EP2018/051684; completed Jan. 22, 2019.

* cited by examiner

VIBRATION GENERATOR AND METHOD FOR GENERATING VIBRATIONS

The invention relates to a construction machine with vibration generator having a first rotationally drivable imbalance shaft, on which a first imbalance is arranged, at least one second rotationally drivable imbalance shaft, on which a second imbalance is arranged, a joint drive for rotationally driving the two imbalance shafts and a transmission arrangement which is arranged between the drive and the imbalance shafts for transmitting a torque of the drive to the imbalance shafts, in accordance with the preamble of claim 1.

The invention further relates to a method for operating a construction machine, in which a drive rotationally drives a first imbalance shaft, on which a first imbalance is arranged, and a second imbalance shaft, on which a second imbalance is arranged, and a transmission arrangement, which is arranged between the drive and the imbalance shafts, transmits a torque of the drive to the imbalance shafts, in accordance with the preamble of claim 10.

A construction machine of the related art having mast arranged at a carrier unit and a vibration generator is known from EP 3 228 392 A1.

Vibration generators can be employed for many different purposes. For instance, in construction engineering they can be used for introducing and/or removing sheeting elements into or out of the soil. For this, a vibrator having a vibration generator can be used. The vibrator can be mounted as an attachment vibrator onto a sheeting element, such as a sheet pile element, a plank or a pipe, in order to transmit vibrations thereto during the introduction into or removal from a ground.

From DE 42 24 113 A1 a vibration exciter for a vibration apparatus with two imbalances arranged adjacent to each other is known. Both imbalances are driven via a transmission with a drive shaft, with a torque being transmitted from a motor to adjacently supported shafts of the transmission and the imbalances.

In U.S. Pat. No. 4,830,597 a vibrator for a machine for producing concrete shapes is described. The vibrator has several imbalances arranged offset as imbalance pairs, in which case a pair of imbalances is driven by a drive shaft and the two imbalances of the imbalance pair are coupled to each other in a transmission-like manner for the torque transmission.

In such vibration generators the imbalance pairs and the transmission provided for the torque transmission form a unit which is induced to vibrate by the imbalances set into rotation. Although this permits an efficient pairwise drive of the imbalances, the transmission also suffers vibrations and is thereby subject to intense stress.

In DE 102 35 980 A1 a vibratory mechanism with two motors for a vibratory compactor machine is described. A first motor is connected to a first weight and a second motor is connected to a second weight via drive shafts.

Furthermore, from U.S. Pat. No. 3,670,631 a vibrator with two rotating eccentric masses is known, in which case the two masses are movable relative to each other to produce a vibrating and a non-vibrating condition.

In DE 10 2010 056 531 A1, JP 2002 129563 A, U.S. Pat. No. 5,934,824, DE 1 920 221 U, U.S. Pat. No. 5,584,375, US 2004/173040 A1, GB 1536765 A and DE 295 16 602 U1 vibration generators with two imbalances are described too.

The invention is based on the object to provide a construction machine and a method for operating a construction machine, with which vibrations can be generated to be more in a manner safeguarding the components to a greater extent and with a compact design.

In accordance with the invention the object is achieved by a construction machine having the features of claim 1, and by a method for operating a construction machine having the features of claim 10. Preferred embodiments of the invention are stated in the respective dependent claims.

The construction machine according to the invention is characterized in that the transmission arrangement distributes an input torque of the drive to a first output element for the first imbalance and at least one second output element for the at least second imbalance, in that for the torque transmission a first deflection element is arranged between the first output element of the transmission arrangement and the first imbalance shaft and in that for the torque transmission a second deflection element is arranged between the second output element of the transmission arrangement and the second imbalance shaft, wherein the first compensating element and the second compensating element are designed to compensate an axial offset between the first output element and the first imbalance shaft and the second output element and the second imbalance shaft respectively.

A deflection element according to the invention permits a deflection mainly in a direction transverse to the shaft axis. This can substantially comprise torsionally rigid, movable shafts or coupling elements supported in an angularly and/or transversely movable manner. Within the meaning of the invention a deflection element can therefore be understood in particular as a torsionally rigid, angularly movable coupling. Such a coupling can, for example, be an articulated shaft that has at least one universal or Cardan joint. Furthermore, within the meaning of the invention a deflection element can also be understood as a torsionally rigid, transversely movable coupling. Such a coupling can, for example, be a bellows-like hollow shaft that is movable transversely to the shaft axis or a radially adjustable disk. The deflection elements can compensate not only a radial offset but also an axial and/or angular offset.

The provision or arrangement of a component of the vibration generator between other components of the vibration generator according to the invention can be understood not only in a spatial sense but also in a functional one, in particular in the sense of an interposed provision or arrangements.

A basic idea of the invention resides in the fact that a transmission arrangement of a vibration generator provided for the torque transmission is arranged such that it is substantially vibration-decoupled from the vibrating imbalances and their shafts. In the invention it was found that such a vibration-decoupled arrangement can be realized by means of several deflection elements, in which case each deflection element on the one hand permits a torque transmission from the transmission arrangement to an imbalance shaft and on the other hand substantially reduces a transmission of vibrations from the imbalance shaft to the transmission arrangement.

Thus, compared to known vibration generators the vibration generator has the advantage that the vibrations generated by the imbalances are transmitted to a lesser extent to a transmission. This has the advantage that the transmission is subject to less stress and can therefore be operated with less wear.

The invention is based on the further finding that a vibration decoupling of the transmission from the vibrating imbalance shafts can be realized irrespective of the spatial position of the transmission arrangement relative to the imbalances if the imbalance shafts and the imbalances disposed thereon are arranged in a particularly compact way as an imbalance unit. According to the invention this compact arrangement is realized by supporting the first imbalance shaft in the second imbalance shaft and by arranging the second imbalance in a circulating manner around the first imbalance.

A preferred embodiment of the vibration generator resides in the fact that in order to form an imbalance unit the first imbalance shaft is rotatably supported inside the second imbalance shaft and in that the second imbalance is arranged in a circulating manner around the first imbalance. For the torque transmission between the transmission arrangement and the first imbalance shaft a first deflection shaft can be arranged and for the torque transmission between the transmission arrangement and the second imbalance shaft a second deflection shaft can be arranged. The imbalance unit can also be referred to as an imbalance cell. A preferred embodiment of the construction machine according to the invention resides in the fact that at least one of the deflection elements is a Cardan shaft which has a Cardan joint on at least one side. Preferably, on the Cardan shaft one Cardan joint each is provided on both sides. One of the Cardan joints can connect the Cardan shaft to one of the imbalances and the other Cardan joint can connect the Cardan shaft to the transmission arrangement. The Cardan shaft is designed such that it is able to absorb vibrations of the imbalances and the imbalance shafts in different directions, for instance in a vertical or a horizontal direction. This means that starting from a firmly arranged transmission arrangement a torque can be transmitted via the Cardan shaft to an imbalance shaft while the Cardan joints move (also) according to the vibration movements of the imbalance shafts.

The Cardan shaft can also be designed as a hollow Cardan shaft, in which another deflection element, preferably a second deflection or Cardan shaft, is arranged coaxially.

Another preferred embodiment of the construction machine according to the invention resides in the fact that at least one of the deflection elements is designed as a movable hollow shaft. By preference, the movable hollow shaft can be designed as a transversely movable hollow shaft. While the first deflection element, as a Cardan shaft, can transmit a torque from the transmission arrangement to the first imbalance shaft, the second deflection element, as a movable hollow shaft, can surround the first deflection element and transmit a torque to the second imbalance shaft that surrounds the first imbalance shaft. For this purpose, both the first deflection shaft is connected in a torque-proof manner to the first imbalance shaft and the second deflection shaft is connected in a torque-proof manner to the second imbalance shaft and the two deflection shafts are connected in a torque-proof manner to the transmission arrangement. An advantage of this embodiment is that the transmission arrangement can be provided on one side of the imbalances so that these can be driven from one side only. As a result, the vibration generator can be constructed in a particularly compact way.

Basically, the movable hollow shaft can be designed as an arbitrary torsionally rigid and at least transversely movable coupling. A preferred embodiment of the vibration generator according to the invention resides in the fact that the movable hollow shaft is designed as a metal bellows tube. The metal bellows tube can have the function of a metal bellows coupling between the transmission arrangement and the second imbalance shaft. A metal bellows tube can have a central bellows and two externally disposed hubs. The central bellows allows a relative displacement of both hubs to each other in a direction transverse to the axis of the hollow shaft. The bellows of the metal bellows tube can absorb vibrations in particular transversely but also longitudinally to the bellows axis. The two hubs connected in a torque-proof manner to the bellows enable a torsionally rigid coupling of the metal bellows tube with one of the imbalance shafts and with the transmission arrangement.

Another preferred embodiment of the invention resides in the fact that at least one of the deflection elements has a movable coupling with a radially displaceable coupling disk. By preference, on both sides of the radially displaceable coupling disk two or more deflection levers are rotatably articulated onto one of its ends. The other respective end of the deflection levers is arranged in a rotatable manner on the shaft adjoining in each case. This means that the levers are connected on one side to the associated output element of the transmission arrangement and on the other side to the imbalance shafts. Preferably, a coupling with such a radially displaceable coupling disk is designed as a so-called Schmidt coupling.

Basically, the transmission arrangement can be arranged or interposed in any chosen way between the drive, more particularly a drive motor, and the imbalance shafts in order to transmit a torque of the drive to the imbalance shafts. A preferred embodiment of the vibration generator resides in the fact that the transmission arrangement is provided on one side of the imbalance unit. In particular, this can be provided if the first and the second imbalance shaft are driven unilaterally. For this, it can be especially expedient that the first imbalance shaft is driven by way of an articulated shaft, in particular a Cardan shaft, and the second imbalance shaft is driven by way of a movable hollow shaft that surrounds the articulated shaft.

For the torque transmission from the drive to the imbalance shafts provision can in particular be made in that a transmission drive shaft which is operatively connected to the transmission arrangement is rotationally driven by the drive. Alternatively, provision can also be made in that a torque is introduced in another known way into the transmission arrangement with a drive motor that is operatively connected to the transmission arrangement. An adjustment drive for adjusting the rotational position of the imbalances can also be designed as a drive for the torque transmission. The transmission arrangement can in particular have a gearwheel transmission. The gearwheel transmission can be designed as a spur gear transmission that can drive the two imbalance shafts synchronously. One gearwheel of the transmission arrangement can drive the first deflection shaft and a further gearwheel of the transmission arrangement can drive the second deflection shaft. The two gearwheels for driving the two deflection shafts can also be arranged in two different power trains. The two power trains can be driven independently of each other, but in particular synchronously, by the drive.

A preferred embodiment of the construction machine according to the invention resides in the fact that an adjustment motor for adjusting an angular offset of the imbalances to each other is arranged on or in the transmission arrangement. The adjustment motor can have pivoting means adjustable with respect to each other, in particular gearwheels rotatable with respect to each other, which are operatively connected to the deflection shafts and via which a torque can be transmitted. The adjustable pivoting means can thus allow a pivoting of the individual imbalances and/or imbalance shafts for their synchronization and, in doing so, adjust with respect to each other gearwheels or gearwheel rims that drive the deflection shafts. The transmission arrangement can thus also be understood as synchronization or drive transmission.

Another preferred embodiment of the vibration generator resides in the fact that the second imbalance shaft is rotatably supported in a housing that surrounds the first imbalance and the second imbalance. On the one hand the housing offers protection against the rotating and vibrating imbalances and on the other hand it can be used to fix a working tool on the vibration generator.

Inside a housing several imbalance units can also be arranged in a redundant way, in particular three or four, which can be jointly driven by the drive via the transmission arrangement by means of two deflection shafts in each case. The transmission arrangement can drive several imbalance units synchronously. For this purpose, the transmission arrangement preferably has a spur gear transmission with one or several power trains.

Basically, any type of working tools can be attached to the vibration generator. According to the invention an especially preferred embodiment resides in the fact that a clamping means for clamping a working instrument, in particular a sheeting element, such as a sheet pile element, is fixed on the housing. The clamping means can have a parallel gripper for gripping and clamping the working instrument. In this way, vibrations can be transmitted via the housing to the clamping means and further on to the working instrument. This can facilitate the introduction of a sheeting element into the soil for example.

The construction machine according to the invention has the vibration generator.

The construction machine according to the invention has a mast which is arranged on a carrier unit resides in the fact that the vibration generator is arranged on a carriage guided on the mast, wherein the transmission arrangement and the drive of the vibration generator are fixed on the carriage. The adjustment motor can also be fixed on the carriage. The carriage of the construction machine guided on the mast can thus also be vibration-decoupled. Vibrations generated by the imbalances can be transmitted via a housing that surrounds the imbalance unit to a working tool arranged on the housing. This can, for example, be a clamping means for clamping a sheeting element and for introducing this into the soil.

Another advantageous embodiment of the construction machine according to the invention resides in the fact that the vibration generator is guided on a leader. As leader a guide means of a pile driver can be understood which can introduce tubes or sheet piles into the foundation ground. Such a leader-guided vibration generator, in particular a leader-guided attachment vibrator, has the advantage that a sheeting element can be introduced into the soil with greater precision as is the case with a free-riding attachment vibrator.

With regard to the method according to the invention the aforementioned object is achieved in accordance with the invention in that a first deflection shaft transmits the torque of the drive from a first output element of the transmission arrangement to the first imbalance shaft and in that a second deflection element transmits the torque of the drive from a second output element of the transmission arrangement to the second imbalance shaft, wherein the first compensating element and the second compensating element are designed to compensate an axial offset between the first output element and the first imbalance shaft and the second output element and the second imbalance shaft respectively. By way of the method according to the invention the previously described vibration generator can be operated and the previously described advantages can be achieved. By preference, provision can be made for the second imbalance to circulate around the first imbalance, wherein the first imbalance shaft is supported inside the second imbalance shaft, a first deflection shaft transmits the torque of the drive from the transmission arrangement to the first imbalance shaft and a second deflection shaft transmits the torque of the drive from the transmission arrangement to the second imbalance shaft.

A preferred embodiment of the method according to the invention resides in the fact that the two imbalance shafts are driven in a counter-rotating manner. Due to the counter-rotational driving of the imbalance shafts and the resultant counter-rotating imbalances vibrations can be compensated in one plane, e.g. the horizontal spatial plane, whereas in another plane, e.g. the vertical spatial plane, vibrations can add up.

Another advantageous embodiment of the method according to the invention resides in the fact that the two imbalance shafts are driven synchronously. To this end, the transmission arrangement can be designed as a synchronization transmission. By synchronously driven imbalance shafts, simultaneously driven imbalance shafts, i.e. driven at the same angular speed, can be understood. The imbalance shafts can be driven in a synchronous co-rotating manner or in a synchronous counter-rotating manner.

According to the invention another advantageous embodiment of the method pursuant to the invention resides in the fact that an offset of the imbalances in a starting position of the imbalances, in which the imbalances are arranged opposite each other, is corrected. Such an offset correction enables in particular in a counter-rotational driving the two imbalances to be located opposite each other in the upper starting position and in a lower position, which means that they meet, and in which case they are located opposite at an angular offset of 90° to both positions, whereby vibrations occurring in this plane are compensated.

By means of the construction machine according to the invention a structure can be built. Such a structure can, for example, be an excavation pit enclosure that is constructed with sheeting elements that have been introduced into the ground using the vibration generator according to the invention.

Figure 2:
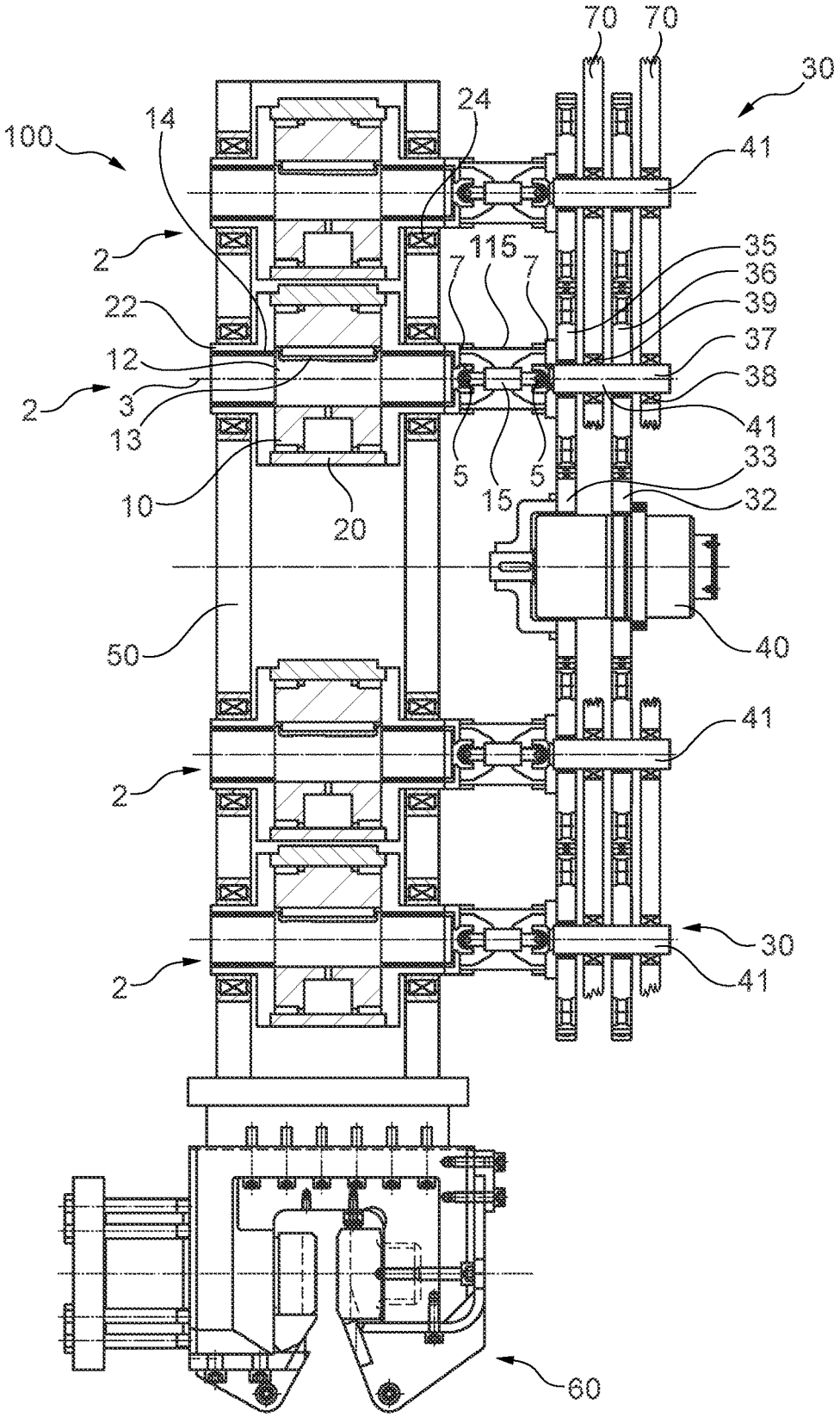
Figure 3:
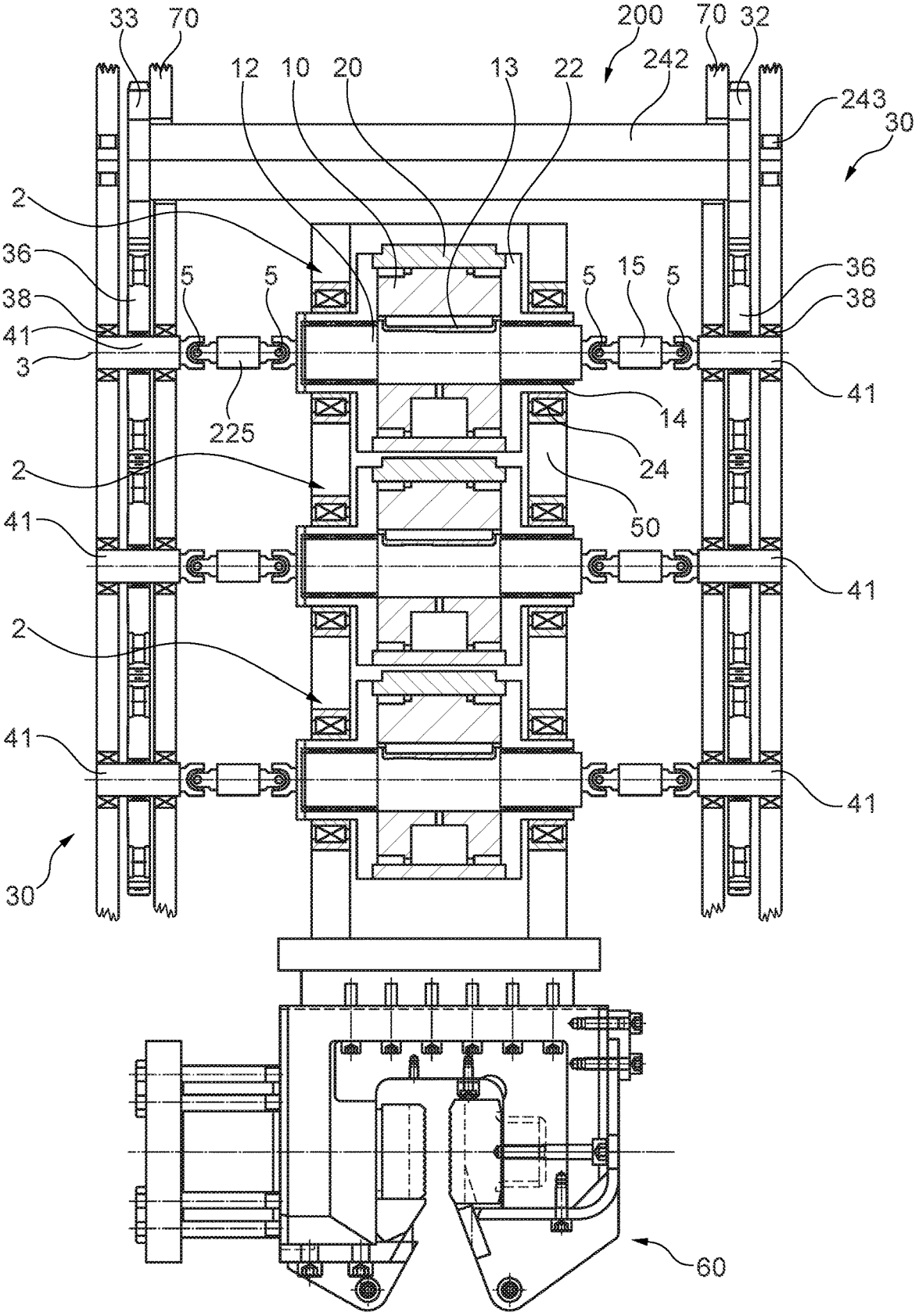
Figure 4:
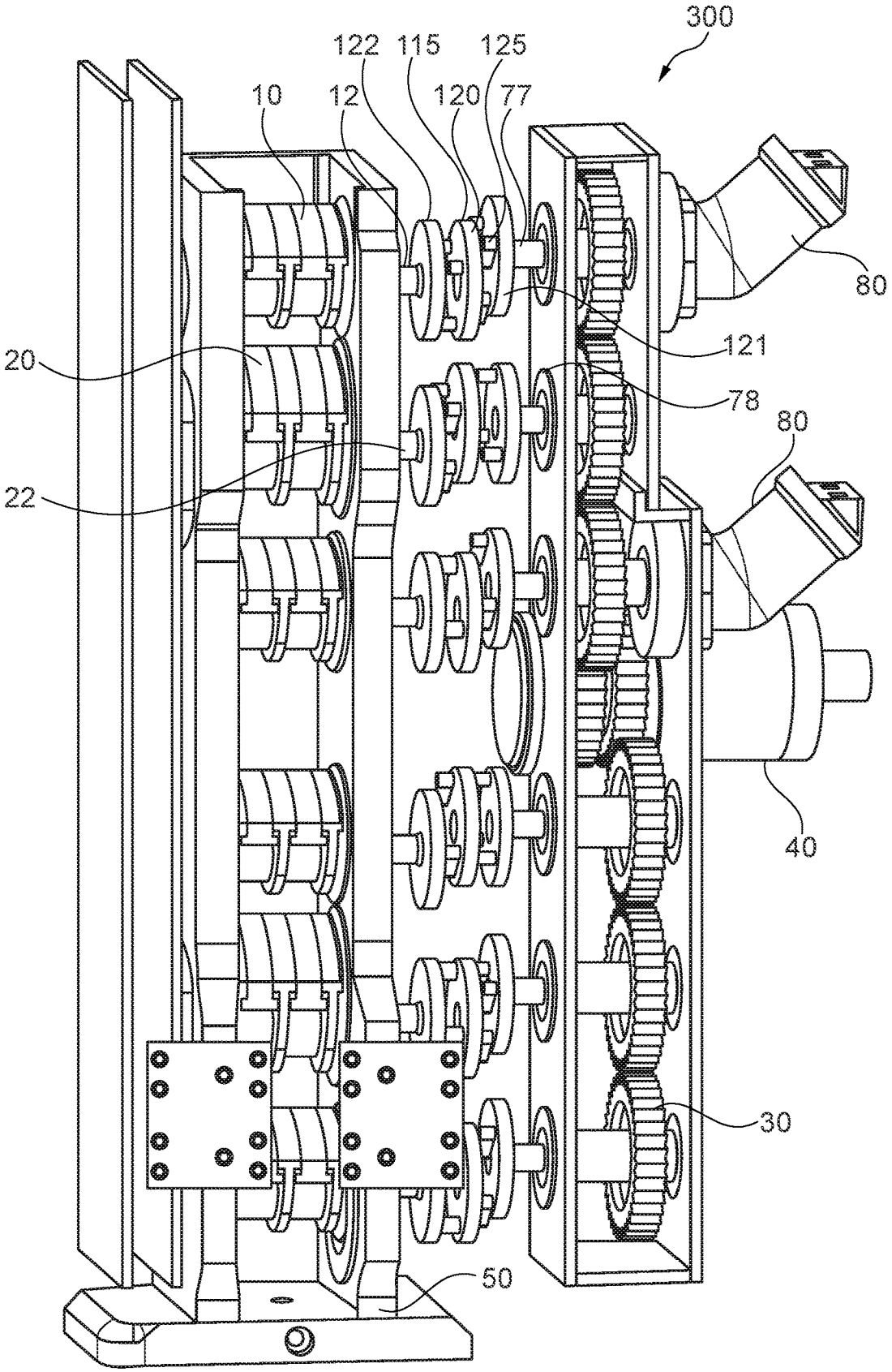
Figure 5:
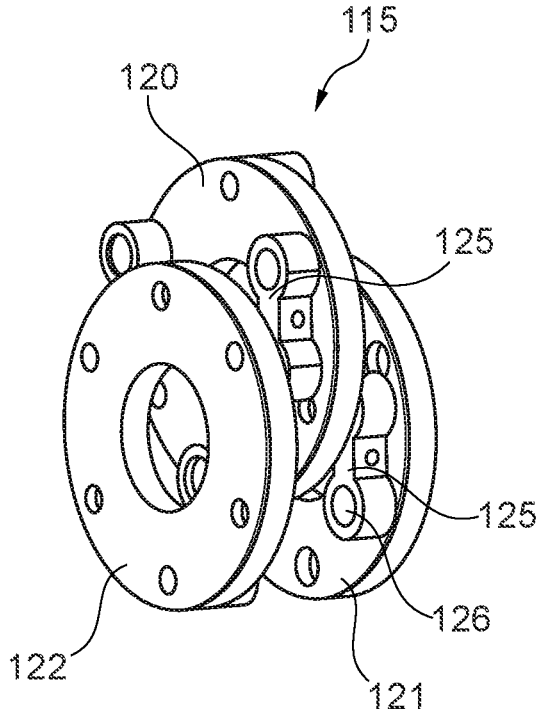

The invention is set out hereinafter by way of preferred embodiments illustrated schematically in the accompanying drawings, wherein show:

FIG. 1 a side view of a first vibration generator with three imbalance units and a transmission arrangement on one side for the invention;

FIG. 2 a side view of a second vibration generator with four imbalance units and a transmission arrangement on one side for the invention;

FIG. 3 a side view of a third vibration generator with three imbalance units and a transmission arrangement on two sides for the invention;

FIG. 4 a cross-sectional view of a further embodiment of a vibration generator for the invention;

FIG. 5 a first perspective view of a compensating coupling; and

Figure 6:
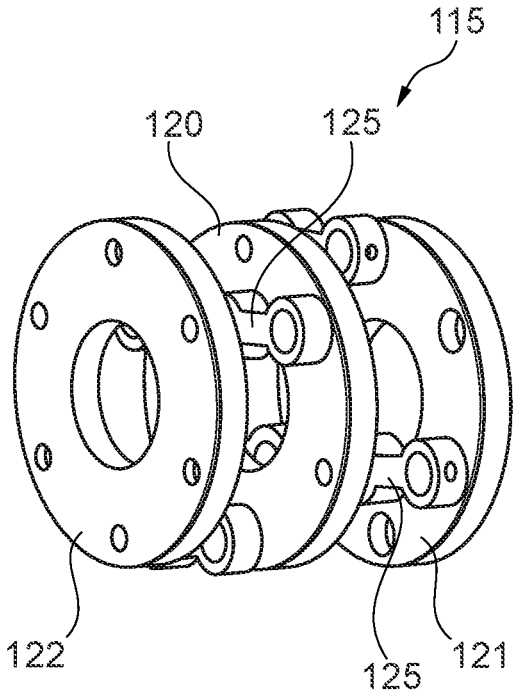

FIG. 6 a second perspective view of a compensating coupling.

FIGS. 1 to 3 each show a vibration generator 100, 200 with a plurality of imbalance units 2. In all of these embodiments of the vibration generator 100, 200 the individual imbalance units 2 are substantially of the same design.

A single imbalance unit 2 comprises a first imbalance shaft 12 with a first imbalance 10 and a second imbalance shaft 22 with a second imbalance 20. The first imbalance shaft 12 and the second imbalance shaft 22 are supported coaxially, with the first imbalance shaft 12 being located at least in sections inside the second imbalance shaft 22.

The second imbalance shaft 22 is designed as a hollow shaft. The first imbalance shaft 12 is supported by means of a first imbalance radial bearing 14 in the second hollow imbalance shaft 22.

On the first imbalance shaft 12 the first imbalance 10 is arranged by way of a shaft-hub-connection 13. The shaft-hub-connection 13 can be a fitted key connection. The second imbalance shaft 22 surrounds the first imbalance 10, with the second imbalance 20 being arranged in such a manner on or in the peripheral surface of the second imbalance shaft 22 that it is arranged offset radially outwards with respect to the joint shaft axis 3 of the coaxially arranged first imbalance shaft 12 and the second imbalance shaft 22. If both imbalances 10, 20 are set into rotation the second imbalance 20 thus circulates around the first imbalance 10.

The second imbalance shaft 22 is supported in a housing 50 by way of second imbalance radial bearings on both ends of the second imbalance shaft 22. Second imbalance radial bearings 24 and first imbalance radial bearings 14 are arranged at the end sections of the first imbalance shaft 12 and the second imbalance shaft 22, with the two imbalances 10, 20 being arranged in-between the two end sections. The housing 50 thus surrounds the two imbalances 10, 20 that can rotate in the interior of the housing 50. The housing 50 can encase the imbalances 10, 20 and at least in sections the imbalance shafts 12, 22. The imbalance units 2 and the housing 50 form a vibrating unit since vibrations generated by the imbalances are transmitted via the imbalance shafts 12, 22 to the housing 50.

Furthermore, FIGS. 1 to 3 each show a clamping means 60 as a working tool, onto which vibrations can be transmitted with the vibration generators 100, 200 according to the invention.

In FIGS. 1 and 2 the two imbalance shafts 12, 22 are articulated by way of a Cardan shaft 15 and a movable hollow shaft 115 on a transmission arrangement 30. These two deflection shafts, the Cardan shaft 15 and the movable hollow shaft 115, are arranged coaxially. The Cardan shaft 15 is located in the interior of the movable hollow shaft 115. In an idle position of the vibration generator 100 a joint shaft axis of the Cardan shaft 15 and the movable hollow shaft 115 can be parallel to the shaft axis 3 of the imbalance shafts 12, 22.

The Cardan shaft 15 is articulated by way of a first Cardan joint 5 on the first imbalance shaft 12 and by way of a second Cardan joint 5 on a transmission shaft 37 of the transmission arrangement 30, which is rotationally driven by a drive (not shown). A torque of the driven transmission shaft 37 can thus be transmitted via the Cardan shaft 15 to the first imbalance shaft 12 and the first imbalance 10.

The movable hollow shaft 115 can be designed as a metal bellows tube for example. The movable hollow shaft 115 is flanged by way of a first hub 7 on the second imbalance shaft 22. This first hub 7 can therefore be referred to as imbalance hub of the movable hollow shaft 115. At the other end of the movable hollow shaft 115 it is flanged by way of a second hub 7 on an output gearwheel rim 35 of the transmission arrangement 30. The second hub 7 can therefore be referred to as gearwheel hub of the movable hollow shaft 115. For a torque transmission from an output gearwheel rim 35 of the transmission arrangement 30 to the second imbalance shaft 22 the movable hollow shaft 115 is flanged by means of two flange hubs 7. By way of a gearwheel rim bearing 39 the output gearwheel rim 35 can furthermore be supported radially on the driven transmission shaft 37. By way of the transmission arrangement 30 a torque can be transmitted from the driven transmission shaft 37 via an adjustment motor 40 to the output gearwheel rim 35 and therefore also to the movable hollow shaft 115 and the second imbalance shaft 22.

If the imbalance units 2 and the housing 50 are set into vibration, both the Cardan shaft 15 and the movable hollow shaft 115 can move in the direction of the vibrations and thereby absorb or cushion vibrations.

In FIG. 1 a transmission arrangement 30 is shown that transmits a torque of a drive (not shown) to three imbalance units 2. The transmission arrangement 30 has two power trains that are both driven by the drive. The two power trains extend from the adjustment motor 40 which has two intermediate gearwheels 32, 33 that can be adjusted to each other and locked. When the intermediate gearwheels 32, 33 are locked a torque can be transmitted from the drive via the adjustment motor 40 to the imbalance shafts 12, 22 and when the intermediate gearwheels 32, 33 are not locked an angular offset between the imbalances 10, 20 can be set or corrected by the adjustment motor 40.

The first power train forms a spur gear transmission of several drive wheels 36 that engage with each other and are driven synchronously by the driven transmission shaft 37. On each of these drive wheels 36 a transmission shaft 41 is located axially that is connected in a torsionally rigid manner via one of the Cardan joints 5 to a Cardan shaft 15 in each case. One of the transmission shafts 41 is the driven transmission shaft 37.

The drive wheels 36 of the spur gear transmission can have the same circumference, whereby the transmission shafts 41 are driven at the same rotational speed and therefore the imbalance shafts 12 articulated by way of the Cardan shafts 15 also rotate at the same rotational speed.

For the torque transmission from the drive to the second imbalances 20 the second power train has several output gearwheel rims 35. As spur gear transmission the output gearwheel rims 35 are in engagement with each other and driven via the intermediate gearwheels 32, 33.

The output gearwheel rims 35 can also have the same circumference and therefore be driven at the same rotational speed. The transmission shafts 41 of the first power train are each supported in the output gearwheel rims 35 by means of a transmission shaft radial bearing 38. Hence, a transmission shaft 41 runs through an output gearwheel rim 35.

The adjustment motor 40 can be designed such that the two intermediate gearwheels 32, 33 and therefore also the two imbalance shafts 12, 22 are driven in a co-rotating or counter-rotating manner by the drive.

The drive, the adjustment motor 40 and/or the transmission arrangement 30 can be fixed on a construction machine or a construction tool (both not shown). Due to the movable articulation by way of the Cardan shafts 15 and the movable hollow shafts 115 vibrations of the imbalance units 2 and the housing 50 are absorbed by the deflection shafts, the Cardan shafts 15 and the movable hollow shafts 115. Hence, the vibrations generated by the imbalance units 2 are substantially not transmitted to the transmission arrangement 30 and the drive. To fix the transmission arrangement 30 holders 70 are shown to some extent, in which the transmission shafts 41 can be supported by way of transmission shaft radial bearings 38. Further holders for fixing the transmission arrangement 30, the adjustment motor 40 and the drive, for instance on the non-depicted construction machine or the construction tool, can be provided in addition.

FIGS. 1 to 3 each show a clamping means 60 that is fixed on the vibrating housing 50. The clamping means 60 can clamp a sheet pile element for example in order to transmit thereto vibrations of the vibration generator 100, 200.

The embodiment of the vibration generator 100 shown in FIG. 2 solely differs from the embodiment shown in FIG. 1 in that four imbalance units 2 instead of three imbalance units 2 are provided. In principle, the vibration generator 100 can be designed with any number of imbalance units 2.

However, a plurality of imbalance units 2 advantageously describes a vibration redundancy concept to enhance the generated vibrational forces.

The embodiment shown in FIG. 2 additionally differs from the embodiment shown in FIG. 1 in that the adjustment motor 40 is arranged centrally, in which case the first and the second intermediate wheel 32, 33 transmit a torque to power trains lying opposite in each case that can otherwise be designed identically to the power trains in FIG. 1.

While in FIGS. 1 and 2 the drive, the adjustment motor 40 and the transmission arrangement 30 are arranged on one side of the imbalance units 2 and the housing 50, in the embodiment of the vibration generator 200 shown in FIG. 3 the transmission arrangement 30 is located on both sides of the imbalance units 2.

While in the embodiments of the vibration generator 100 in FIGS. 1 and 2 the imbalance shafts 12, 22 are articulated on one side on the transmission arrangement 30, the imbalance shafts 12, 22 in FIG. 3 are articulated on two opposite sides.

In FIG. 3 the first imbalance shaft 12 is articulated by way of a first Cardan shaft 15 on a first power train of the transmission arrangement 30 and the second imbalance shaft 22 is articulated by way of a second Cardan shaft 225 on a second power train of the transmission arrangement 30.

Both Cardan shafts 15, 225 each have two Cardan joints 5. The Cardan shafts 15, 225 can thus be designed as a double-joint shaft. The first Cardan shaft 15 is articulated by way of a Cardan joint 5 on the first imbalance shaft 12 and by way of a further Cardan joint 5 on a transmission shaft 41 of the first power train. The second Cardan shaft 225 is articulated by way of a Cardan joint 5 on the second imbalance shaft 22 and by way of another Cardan joint 5 on a transmission shaft 41 of the second power train.

Both power trains each have several drive wheels 36 with a respective transmission shaft 41. The transmission shafts 41 are supported in transmission shaft radial bearings 38 of a holder 70.

The imbalance shafts 12, 22 of the three imbalance units 2 shown in FIG. 3 can be driven synchronously by the transmission arrangement 30. For the torque transmission from a drive (not shown) to both power trains a drive shaft 242 is provided, on which the two intermediate gearwheels 32, 33 are arranged on the respective ends. The drive shaft 242 is supported by way of drive shaft radial bearings 243 in the holder 70. The holder 70 can be fixed on a construction machine or a construction tool, not depicted. The drive shaft 242 or one of the two intermediate gearwheels 32, 33 can be rotationally driven by the drive.

The imbalance units 2 can thus vibrate centrally between the power trains of the transmission arrangement 30, while the Cardan shafts 15, 225 absorb the vibrations and substantially do not transmit these to the transmission arrangement 30.

The embodiments of the vibration generator 100, 200 shown in FIGS. 1 to 3 illustrate that under the protection of a housing 50 pairs of imbalances 10, 20 arranged in a compact way can vibrate in a vibration-decoupled manner from a transmission arrangement 30.

The compact arrangement of the imbalances in imbalance units 2 and the movable articulation principle separate from the imbalance shafts renders it possible to provide transmission arrangements both on one and on two sides.

As a result of the vibration decoupling the transmission arrangement 30 is on the one hand subject to less stress and due to the described arrangement and articulation principle of the imbalance shafts 12, 22 the transmission arrangement 30 can be designed in a variable manner, in particular on one or on two sides.

A further embodiment of a vibration generator 300 according to the invention is illustrated in FIG. 4. The basic construction of the vibration generator 300 with regard to the imbalance units 10, 20 corresponds to the previously described construction, while a total of four imbalance units 10, 20 is supported in the housing 50.

The transmission arrangement 30 has a total of six shaft-like output elements, with reference being made for the following description to a first output element 77 and a second output element 78. In the illustrated embodiment the drive 80 has two hydraulic drive motors that introduce their torque into the joint transmission arrangement 30, with the introduced torque being evenly distributed by the transmission arrangement 30 to the output elements 77, 78. As set out before, provision is also made in a known manner for an adjustment motor 40 for relative adjustment of the imbalance units 10, 20.

To compensate a possible radial shaft offset between a first imbalance shaft 12 of the first imbalance 10 with respect to the associated first output element 77 or between a second imbalance shaft 22 of the second imbalance 20 with respect to the associated second output element 78 of the transmission arrangement 30 a coupling 115 with a radially adjustable coupling disk 120 is arranged in each case. Such a coupling 115 can also be referred to as a compensation coupling or Schmidt coupling.

Such a Schmidt coupling is graphically illustrated in FIGS. 5 and 6. The coupling 115 has a radially adjustable coupling disk 120 arranged between a right-hand drive disk 121 and a left-hand output disk 122. The drive disk 121 is attached coaxially to the first output element 77, i.e. the first output shaft of the transmission arrangement 30. Correspondingly, the output disk 122 is fixed in a torque-proof and coaxial manner on the imbalance shaft 12 of the first imbalance 10. To compensate a radial offset between the drive disk 121 and the output disk 122 the central coupling disk 120 is in each case connected in an articulated manner via three pivotable levers 125 to the drive disk 121 and the output disk 122 respectively. For this purpose, corresponding bearing pins 126 are in each case attached to the disks 120, 121, 122, on which bearing pins the deflectable levers are supported in a pivotable or rotatable manner. In this way, a torque can be transmitted by the coupling 115 between the output element and the associated imbalance shaft, while a radial offset between drive and output side can be compensated at the same time.

The invention claimed is:

1. Construction machine having a mast, which is arranged on a carrier and having a vibration generator having a housing, a first rotationally drivable imbalance shaft, on which a first imbalance is arranged, at least one second rotationally drivable imbalance shaft, on which a second imbalance is arranged, a drive for rotationally driving the imbalance shafts and a transmission arrangement which is arranged between the drive and the imbalance shafts for transmitting a torque of the drive to the imbalance shafts, and a clamping means for clamping a sheeting element for the soil, which is fixed at the housing, wherein the vibration generator is arranged on a carriage guided on the mast, and the transmission arrangement and the drive of the vibration generator are fixed on the carriage, wherein the transmission arrangement distributes an input torque of the drive to a first output element for the first imbalance and at least one second output element for the at least one second imbalance, for the torque transmission a first deflection element is arranged between the first output element of the transmission arrangement and the first imbalance shaft and for the torque transmission a second deflection element is arranged between the second output element of the transmission arrangement and the second imbalance shaft, wherein the first deflection element and the second deflection element are each designed to permit a deflection mainly in a direction transverse to a shaft axis, and wherein the first deflection element compensates for an axial offset between the first output element and the first imbalance shaft and the second deflection element compensates for an axial offset between the second output element and the second imbalance shaft.

2. Construction machine according to claim 1, wherein in order to form an imbalance unit the first imbalance shaft is rotatably supported inside the second imbalance shaft and in that the second imbalance is arranged in a circulating manner around the first imbalance.

3. Construction machine according to claim 1, wherein at least one of the deflection elements is a Cardan shaft which has a Cardan joint on at least one side.

4. Construction machine according to claim 1, wherein at least one of the deflection elements has a coupling with a radially displaceable coupling disk.

5. Construction machine according to claim 1, wherein at least one compensating element is designed as a movable hollow shaft, in particular as a metal bellows tube.

6. Construction machine according to claim 1, wherein the transmission arrangement is provided on one side of the imbalance unit.

7. Construction machine according to claim 1, wherein an adjustment motor for adjusting an angular offset of the imbalances to each other is arranged on the transmission arrangement.

8. Construction machine according to claim 1, wherein the second imbalance shaft is rotatably supported in a housing that surrounds the first imbalance and the second imbalance.

9. Construction machine according to claim 1, wherein the vibration generator is guided on a leader.

10. Construction machine according to claim 1, wherein the drive is for driving the two imbalance shafts in a counter-rotating manner.

11. Construction machine according to claim 1, wherein the drive is for driving the two imbalance shafts synchronously.

12. Construction machine according to claim 1, wherein the clamping means is for introducing the sheeting element into the soil.

* * * * *